United States Patent [19]

Schutte

[11] 4,006,344

[45] Feb. 1, 1977

[54] MECHANICAL BINARY NUMBER ADDING AND SUBTRACTING APPARATUS

[76] Inventor: George F. Schutte, 2823 Blakeman Ave., Rowland Heights, Calif. 91745

[22] Filed: Feb. 17, 1976

[21] Appl. No.: 658,244

[52] U.S. Cl. ..... 235/68; 35/30; 235/61 R

[51] Int. Cl.[2] ..... G06C 27/00

[58] Field of Search ..... 35/30, 32, 33; 235/68, 235/61 R, 61 A

[56] References Cited

UNITED STATES PATENTS

| | | | |
|---|---|---|---|
| 516,984 | 3/1894 | Clark | 235/68 |
| 3,006,082 | 10/1961 | Libbey | 235/68 X |
| 3,024,976 | 3/1962 | Wales | 235/61 A |
| 3,390,471 | 7/1968 | Godfrey | 35/30 |
| 3,747,844 | 7/1973 | Youngman | 235/68 |

*Primary Examiner*—Ulysses Weldon
*Attorney, Agent, or Firm*—Gary Appel

[57] ABSTRACT

A mechanical apparatus for adding or subtracting binary numbers, in a visual manner, comprises a front plate with first and second rows of ball receiving apertures formed near the plate top. Balls are introduced into these apertures in a manner representing binary ones of the numbers to be added. Near the bottom of the front plate is formed a third row of apertures. A back plate having front plate guides is provided against which the front plate is held. Three rows of recesses formed in the front plate contacting face of the back plate and two additional rows of front plate apertures cooperate, when the plates are held nearly vertically and the front plate is slid upwardly along the back plate, to cause movement of balls from the first two rows of front plate apertures, through the recesses and other apertures and without other moving elements or switches and into the third row of front plate apertures in a manner to indicate in the third row the binary sum of the two binary numbers being added. Provision is also made for subtracting a smaller binary number from a larger, balls representing the larger number being introduced into the first row of apertures, other balls representing the compliment of the smaller number being introduced into the second row of front plate apertures and one additional ball being introduced into a specially positioned "minus" aperture in the second row. Upon operation of the apparatus in the same manner as for adding, the binary difference of the two numbers is obtained in the third row of front plate apertures.

21 Claims, 18 Drawing Figures

MECHANICAL BINARY NUMBER ADDING AND SUBTRACTING APPARATUS

BACKGROUND OF THE INVENTION

1. Field of the Invention

The present invention relates to the field of mechanical analog or equivalents to simple binary calculators, and more particularly to small mechanical apparatus for performing binary addition and substraction.

2. Discussion of the Prior Art

The lives of nearly everyone in this country are affected at least to some extent by computers. For example, our income taxes are audited by computers and many of the items and services we purchase are billed by computers. Prices of small, hand-held or desk top electronic calculators have now decreased to the extent that they are owned by large numbers of people, and have substantially replaced previously used calculators such as slide rules. These small electronic calculators, virtually all of the binary type, are being increasingly used in schools, even in the elementary grades. This latter use is much to the dissatisfaction of many who believe that even with the availability of computers, the basics of arithmetic should be learned, or at least basic operational principles of the binary system used by the computers in their performance of simple and complex operations should be taught.

For this reason, various types of mechanical analogs or equivalents of simple electronic binary calculators have been disclosed to enable visualization and easy learning or teaching of simple binary operations. Such disclosures include those of Libbey, Lieberman et at., Godfrey, Divilbiss and Youngman (U.S. Pat. Nos. 3,006,082; 3,273,794; 3,390,471; 3,403,459 and 3,747,844). Use of mechanical apparatus corresponding to simple electronic binary functions is made possible by characteristics of the binary or radex two system in which all numbers are represented by a series of 0's and 1's, according to the simple binary rule that "1 plus 1 equals 0, carry 1". As an example, in binary form, the number 1 is represented by 0001, the number 2 by 0010, the number 3 by 0011 and the number 4 by 0100.

Although most conventional or arabic numbers require more digits in the binary system, the 0's and 1's are much easier to operate on in the computer. This is because the 0's and 1's can be represented by an off and on states of electronic switches or by either of bistable states of simple flip-flop circuit elements. It is for this same reason that mechanical equivalents can easily be constructed; equivalents in which electrical or electronic switches are replaced by mechanical gates which are acted upon by, for example, balls instead of electronic impulses.

Thus, such disclosures as above referred to employ many pivoting elements which can deflect a ball in either of two directions depending upon whether the element has or has not just previously been acted upon by another ball. The advantages of such mechanical apparatus is that a user may visually follow the computers decision making process and thereby gain an insight into computer design and operation. In an actual electronic computer the operations proceed at such rapid rates that even were lights indicative of the operations provided, the steps could not be followed. But in a mechanical equivalent, the operation can not only be seen, but it is also slowed down to an extent that it can, to some extent, be followed and understood.

Heretofore disclosed mechanical analogs or equivalents to simple electronic binary functions have, however, because they employ numbers of pivoting members, been relatively complex, subject to breaking or malfunction and have been comparatively costly to produce and purchase. They are, for example, generally too costly for one to be provided to each student in a class or even to provide several for each classroom where their use may be desired.

In addition, after balls representing binary 1's are introduced into such mechanical apparatus, the operation generally proceeds in an automatic manner and cannot easily be stopped or slowed for examination of individual steps as may be necessary for explanation and understanding.

For these and other reasons, simpler, less costly and more versatile mechanical binary apparatus are required to fulfill the need for teaching and learning simple binary operations.

SUMMARY OF THE INVENTION

A mechanical apparatus for operating on binary numbers comprises a number of balls for indicating binary "ones," a first plate including means for defining a first row of apertures enabling entry into the apparatus of a selected first binary number by inserting balls into appropriate first row apertures, for defining a second row of apertures, spaced from the first row, enabling entry into the apparatus of a selected second binary number by inserting balls into appropriate second row apertures, and also for defining a third row of apertures for receiving at least some of the balls from the first and second rows and indicating the binary sum of the two selected numbers, and a second plate cooperating with the first plate. Means are associated with the first and second plates for conducting at least some of the balls inserted into the first and second rows of apertures from those rows to the third row of apertures in a manner causing the balls received by the third row to indicate the binary ones of the sum of the two selected numbers, the sum being thereby indicated by the third row. The conducting means is responsive only to generally vertical movement of the first plate relative to the second plate after the two plates are brought into sliding engagement in a predetermined manner.

More specifically, the conducting means includes first, second and third rows of ball receiving recesses in the first plate contacting surface of the second plate and fourth and fifth rows of ball receiving apertures in the first plate intermediate the third row and the first and second rows of first plate apertures.

Lower portions of the fourth and fifth row apertures are formed in concave shape. When one ball is in any of such apertures and when the first plate is moved upwardly. The gravity centered ball is introduced from the aperture into a first row recess of the second plate; however, when two balls are in any of such recesses and the first plate is move upwardly, the two off center balls bypass the first row recesses and are separately introduced into a second and third row recess. Any balls introduced into any of the third row recesses are retained therein for the remainder of the operation.

Provision is made for subtracting a smaller selected binary number from a larger binary number which is entered into the first row apertures in the first plate to this end, the conducting means also defines a "minus"

aperture at one end of the second row or apertures. Balls indicating the complement of the number to be subtracted are inserted into the second row of apertures and an additional ball is inserted into the minus aperture. Upon operation of the apparatus in the manner of adding binary numbers, the difference between the two selected numbers is indicated by balls conducted to the third row of apertures.

A transparent cover sheet may be fixed to the front of the first plate, in the region of the fourth and fifth row of apertures, to keep balls introduced therein from unintentionally falling out.

In the manner illustrated and described a simple, effective and low cost mechanical equivalent to simple electronic binary functions is provided, and which has no moving parts except for the first, apertured plate and the second, recessed plate.

BRIEF DESCRIPTION OF THE DRAWINGS

A better understanding of the present invention may be had from a consideration of the following detailed description, taken in conjunction with the accompanying drawings in which:

FIGS. 9–18 are a series of front views of the assembled apparatus exemplifying, by showing sequential positions of the front plate relative to the back plate, the addition of the binary numbers 0011 and 0001.

DESCRIPTION OF THE PREFERRED EMBODIMENT

Figure 1:
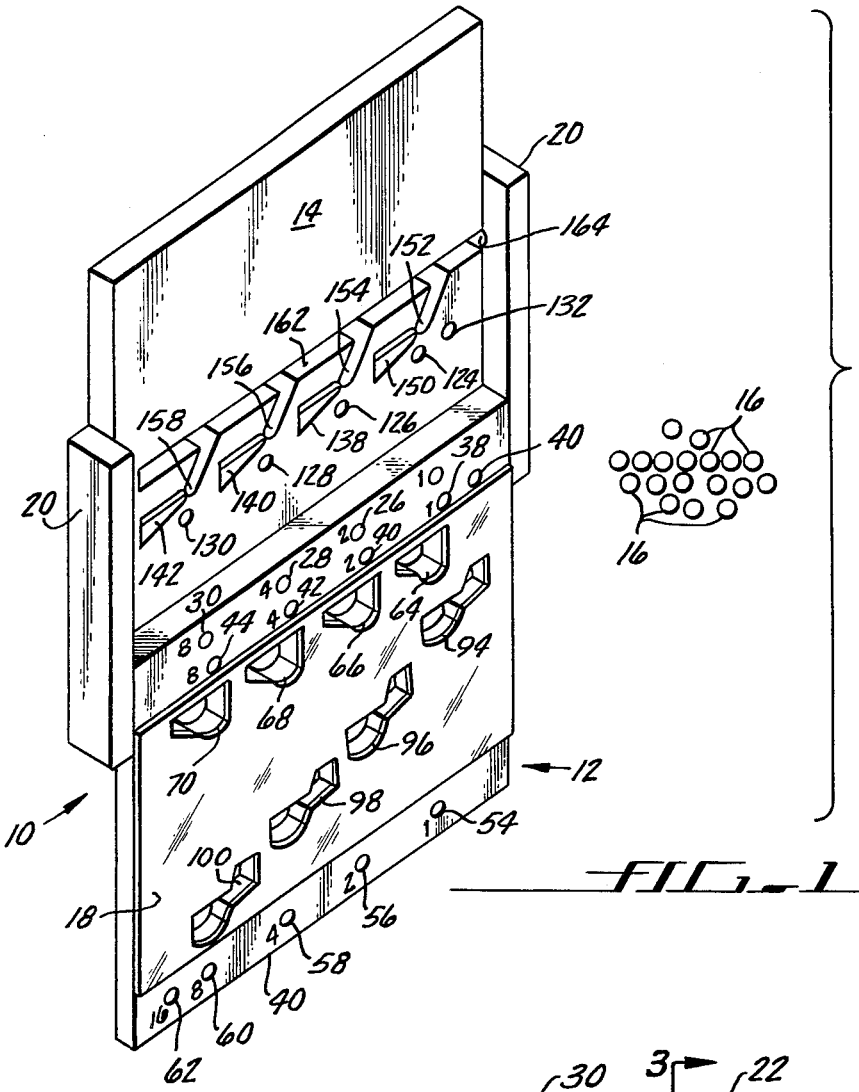
FIG. 1 is a perspective view of the assembled mechanical binary apparatus, showing the position for operation.

As seen in FIG. 1, a mechanical binary apparatus 10 for performing binary addition and subtraction comprises generally an apertured front plate 12, a rear plate 14 having a number of recessed regions (more particularly described below) and a number of similar diameter spherical balls 16, by means of which binary ones are entered into the apparatus. Preferably, major forward surface portions of the front plate 12 are covered with a thin transparent sheet 18, to retain entered balls 16, and side guide members 20 are fixed along major side portions of the back plate 14. The guide members 20 function to keep the two plates 12 and 14 in proper registration during operation of the apparatus 10.

Figure 2:
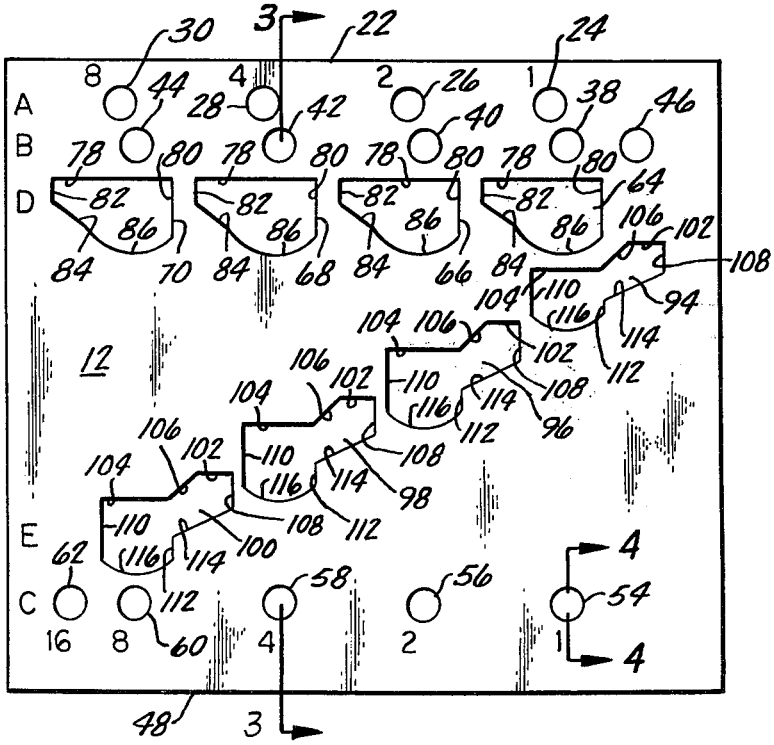
FIG. 2 is a plane view of the front plate, showing features of its construction.

More specifically, and as best seen in FIG. 2, the front plate 12, which is formed of an inexpensive, rigid material such as molded plastic, has joined near an upper edge 22 a first row (row A) of cylindrical apertures: a 1 aperture 24, a 2 aperture 26, a 4 aperture 28 and an 8 aperture 30. The apertures 24–30, having a diameter slightly greater than that of the balls 16 to permit free movement therethrough and extending orthogonally through the front plate 12, are preferably on a straight horizontal line (when the apparatus is in normal use, as explained below) and equally spaced. More than the four shown apertures may be used to represent larger numbers.

Spaced slightly below the first row of apertures (row A) is formed a similarly spaced second row (row B) of cylindrical apertures: a 1 aperture 38, a 2 aperture 40, a 4 aperture 42 and an 8 aperture 44. Each aperture 38–44 of the row B apertures is spaced one half the diameter of the balls 16 to the right (as seen in various Figures) of corresponding ones of the row A apertures. Formed to the right of the 1 aperture 38 of row B, and in line with the apertures of row B is a cylindrical — aperture 46, which is the same size as apertures 38–44. The apertures 38–46 are also sized to receive the balls 16.

A third horizontal row (row C) of cylindrical apertures, similar to those above described, is formed near a lower edge 48 of the first plate. Row C includes a 1 aperture 54, a 2 aperture 56, a 4 aperture 58, an 8 aperture 60 and also a 16 aperture 62. Each of the apertures 54–60 is vertically aligned with a corresponding one of the row B apertures 38–44. The 16 apertures 62 is positioned a short distance to the left of the 8 aperture 60.

Figure 3:
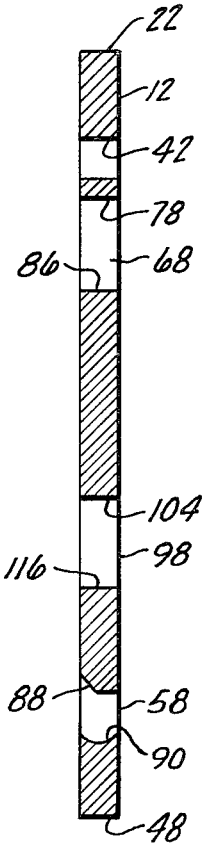
FIG. 3 is a vertical sectional view along line 3—3 of FIG. 2, showing other features of the front plate.

Formed below the row B apertures is a fourth horizontal row (row D) of larger irregularly shaped apertures; a first aperture 64, a second aperture 66, a third aperture 68 and a fourth aperture 70. Each of the apertures 64–70, all of which are substantially identical in shape, has a horizontal upper surface 78, a vertical right hand side 80, a shorter vertical left hand side 82, a sloping left hand lower surface portion 84 and an arcuate right hand lower surface portion 86. The radius of curvature of the portions 86 is preferably equal to about twice the diameter of the balls 16 and the center of radius of each portion 86 is in vertical alignment with corresponding apertures in rows B and C. (See also FIG. 3)

Each of the apertures 64–70 also extends about a ball 16 diameter to the right and several ball diameters to the left of a corresponding one of the row B apertures.

Figure 4:
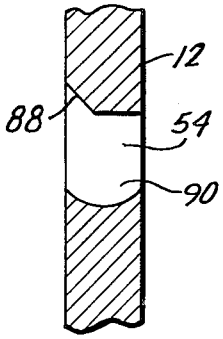
FIG. 4 is a vertical sectional view along line 4—4 of FIG. 2, showing features of some of the front plate apertures.

As seen in FIG. 4, the row C apertures 54–60 are preferably formed having a beveled upper rearward or back portion 88; and a concave lower portion 90 with a radius of curvature equal to about one ball 16 diameter to retain the "answer" balls in the row C apertures.

Formed in the front plate 12, in a staircase or descending row from right to left across the plate, is a fifth row (row E) of irregular apertures which are similar in shape to the row D apertures except that they are extended to the right, rather than to the left of the plate. Row E includes a first aperture 94, a second aperture 96, a third aperture 98 and a fourth aperture 100. Each of the apertures 94–100 has a stepped upper surface that comprises a horizontal right hand portion 102, a lower horizontal left hand portion 104 and an intermediate beveled portion 106. Each such aperture also has a short right hand vertical side 108, a longer vertical left hand side 110, a short intermediate vertical side 112, a right hand lower ramp edge surface 114 from the bottom of the side 108 to the top of the side 112, and an arcuate left hand bottom surface 116 which is substantially identical in shape to the bottom surface portion 86 of the row D apertures 64–70. As were the centers of radius of the surface portions 86, the center of radius of each of the edge portions 116 is in vertical alignment with corresponding ones of the row B and C apertures.

It is important to note that each of the row E apertures 94–100 projects several ball 16 diameters to the right of corresponding ones of the row D apertures to thereby overlap one of the row D apertures to the right of the corresponding row D apertures.

Figure 6:
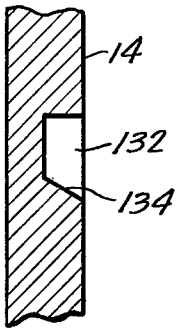
FIG. 6 is a vertical sectional view along line 6—6 of FIG. 5, showing features of some of the back plate recesses.
Figure 5:
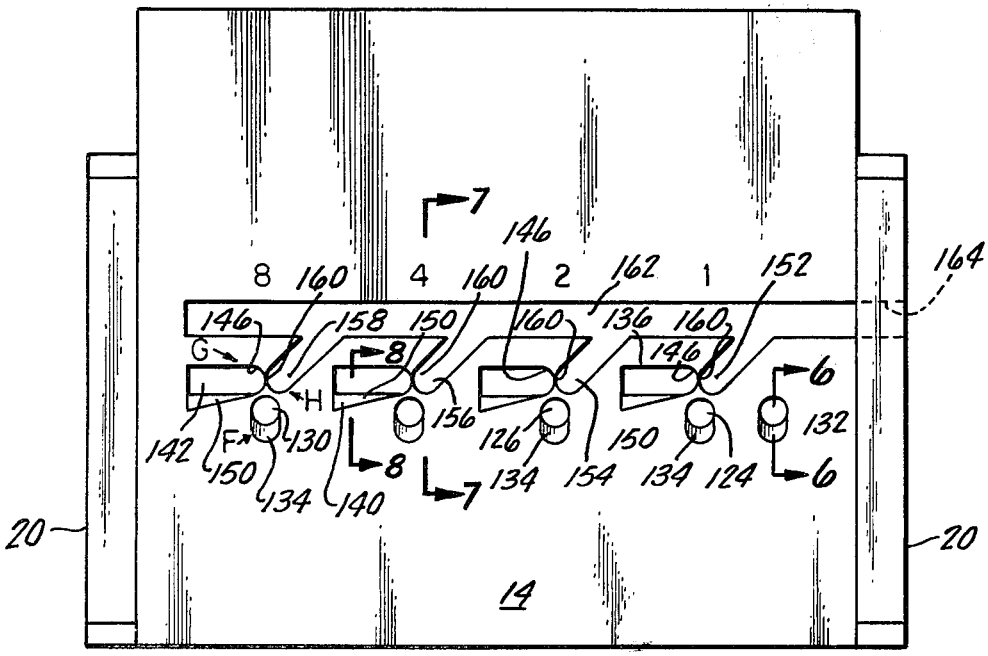
FIG. 5 is a plane view of the back plate, showing features of its construction.

The back plate 14, which is constructed of a material similar to that used for the front plate 12, is best seen in FIG. 5. Formed near the vertical center of the plate 14 is a first horizontal row (row F) of similar recesses: a 1 recess 124, a 2 recess 126, a 4 recess 128 and an 8 recess 130. To the right of the recess 124 is a – recess 132. The recesses 124–134, which have both a diameter and a depth slightly greater than a ball 16 diameter, are positioned so that when the front plate 12 is placed over the rear plate 14, between the guides 20 (FIG. 1) each of the recesses is in vertical alignment with a corresponding one of the row B apertures 38–46. Lower portions 134 of each of the recesses 124–132 are beveled downwardly as seen in FIG. 6 so that balls 16 are automatically discharged therefrom.

Formed just above the row F recesses 124–130, is a second row (row G) of elongate recesses: a first recess 136, a second recess 138, a third recess 140 and a fourth recess 142. Each of the recesses 136–142 has a semicircular right hand side or edge 146 having a radius slightly greater than the ball 16 diameter and which projects, at its farthest point, to the vertical centerline of the corresponding one of the row F apertures 124–130 and is therefore aligned with right hand side portions of a corresponding one of the row A apertures 24–30 in operation. A left hand side 148 of each row G recess is aligned, in operation, with the left hand side 82 of a corresponding one of the row D apertures 64–70. A bottom surface 150 of each row G recess is beveled downwardly towards the left to form an angled ball ramp for automatically discharging ball 16 from the recesses.

Figure 7:
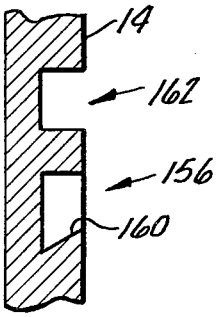
FIG. 7 is a vertical sectional view along line 7—7 of FIG. 5, showing features of other of the back plate recesses.
Figure 8:
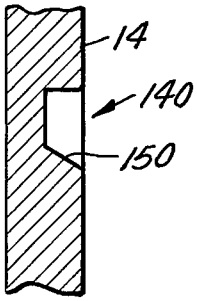
FIG. 8 is a vertical sectional view along line 8—8 of FIG. 5, showing features of still other back plate recesses.

On about the same horizontal level as the row G recesses is formed a third row (row H) of recesses: a first recess 152, a second recess 154, a third recess 156 and a fourth recess 158. Each of the recesses 152–156, which is positioned to the right of a corresponding row G recess, has a semicircular left hand side portion 160 with a radius slightly greater than one ball 16 radius. Semicircular sides 146 and 160 of corresponding row G and row H recesses are in contact along the vertical centerline of corresponding row F recesses. Lowermost portions of the sides 160 of each row H recess are angled downwardly and rearwardly to retain any of the balls 16 introduced into the recesses (FIG. 7).

For convenience, the row H recesses 152–158, which are each angled upwardly to the right, are interconnected by an elongate channel 162 which extends, by means of an aperture 164, outwardly through the right hand one of the guides 20, so that any balls 16 trapped in the row H recesses during operation can be discharged from the apparatus 10.

Operation: Operation of the apparatus can best be described by considering, as an example, the addition, by the apparatus, of two binary numbers: 0011 (equivalent to the number 3) and 0001 (equivalent to the number 1). Addition of these two binary numbers is illustrated step by step in the FIGS. 9–18 which show incremental, sequential upward movement of the first plate 12 relative to the second plate 14, the two plates first having been placed into sliding engagement, with the back of the first plate against the front of the second plate so that the various ones of the front plate apertures of rows A–E can be moved into communication with various ones of the second plate recesses (FIG. 1). For convenience, the front cover plate 18, which covers the rows D and E apertures has not been shown.

Figure 9:
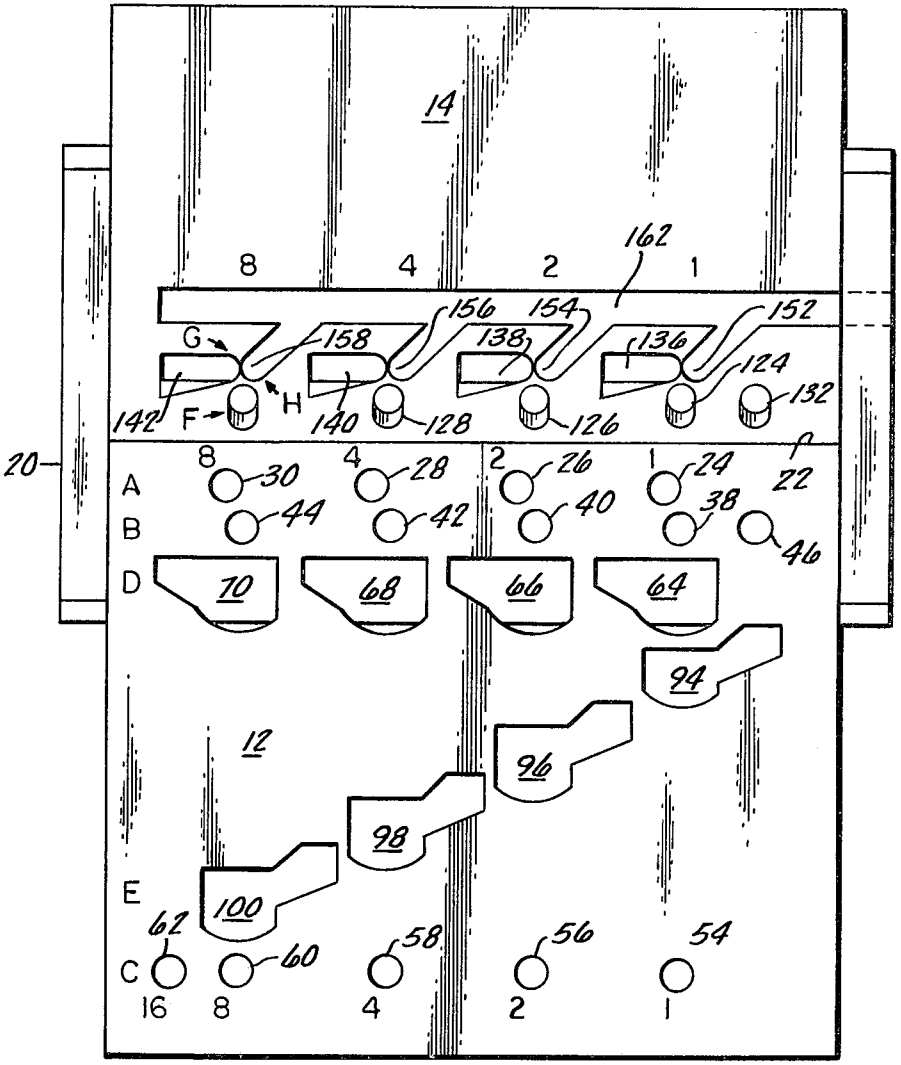
Figure 10:
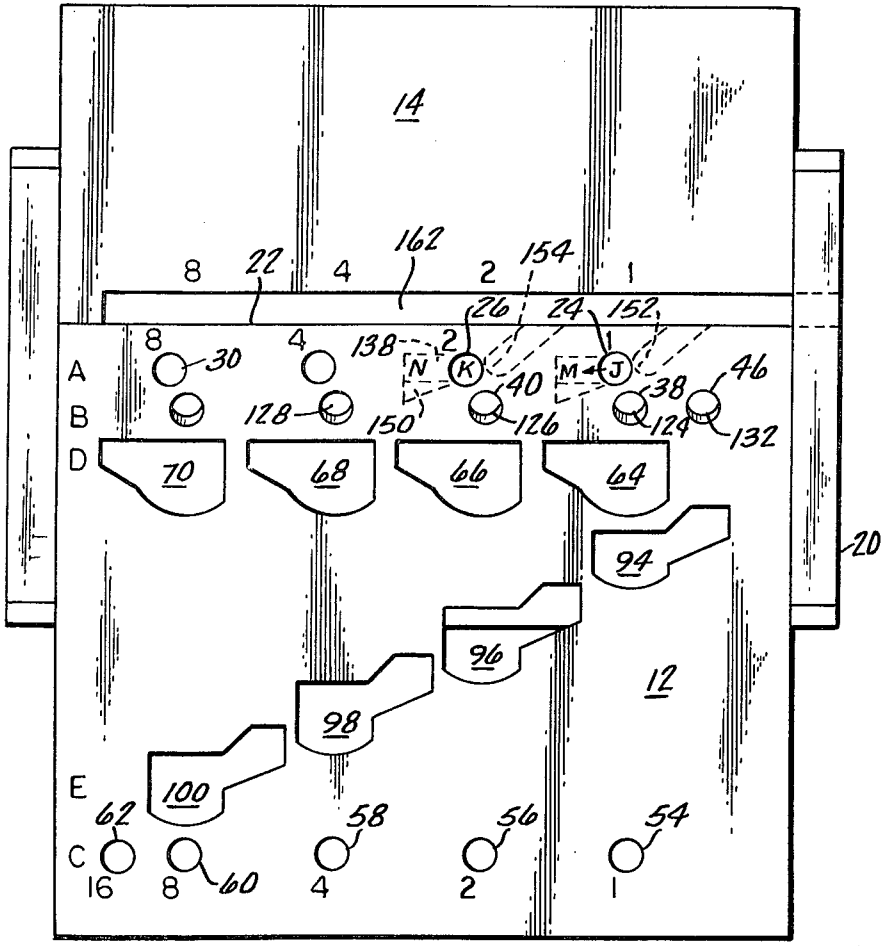
Figure 11:
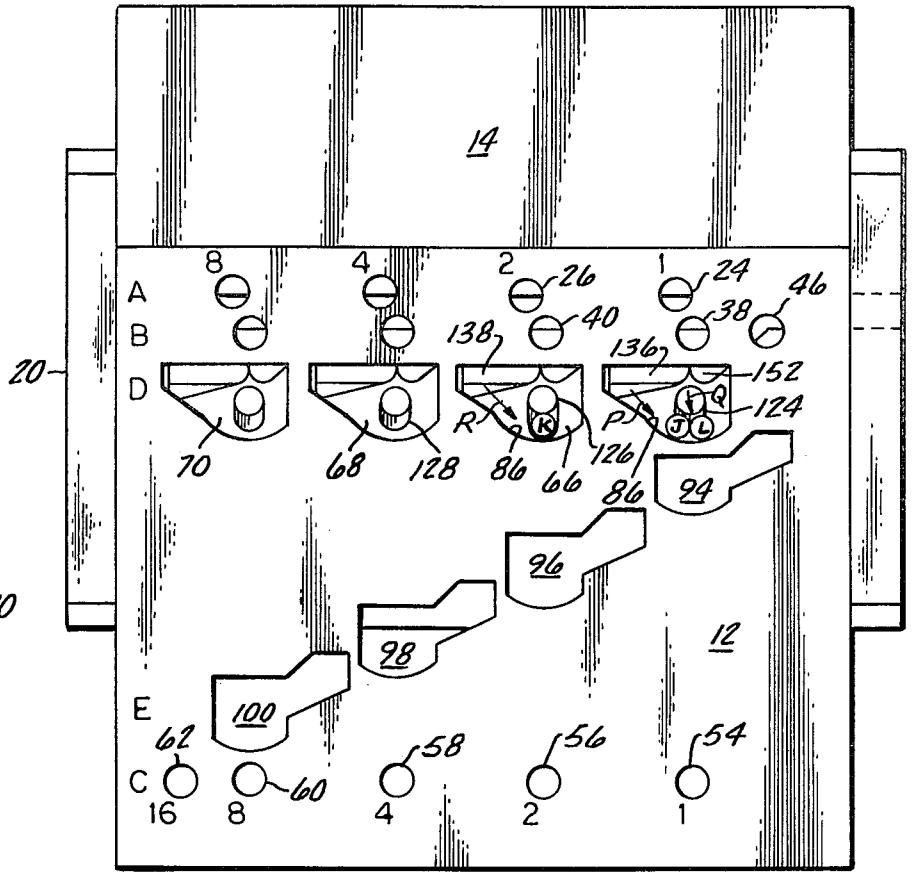

As shown in FIG. 9, the first selected binary number 0011 is "entered" into the first plate 12 (which is initially positioned so that its rows A and B apertures are below all of the second plate recesses) by inserting a first ball 16, identified by the letter J into the row A 1 apertures 24 and by inserting a second ball, identified as K, into the row A 2 aperture 26. Thus, row A is read as 0011, no balls having been inserted into the two left hand apertures 28 and 30. Similarly, the second binary number 0001 is "entered" into the second row, row B, of the front plate 12 by inserting a third ball 16, identified by the letter L, into the row B 1 aperture 38, the other row B apertures 40–44 being left empty to represent 0's. The two binary numbers thus entered in rows A and B may now be added by holding the two plates 12 and 14 very slightly inclined rearwardly from the vertical and then merely by moving the front plate 12 slowly upwardly relative to the second plate 14, as illustrated in FIGS. 10–18.

As plate 12 is moved initially upwardly, ball J will roll upwardly past the second plate 1 recess 124, because the aperture 24 holding the J ball is offset one ball 16 radius to the left of such recess. Similarly, ball K will be rolled past the recess 2 126. Continued upward movement of the first plate 12 (FIG. 10) will then bring the row A apertures 24 and 26, holding balls J and K, respectively, into registration with the corresponding second plate row G 1 and 2 recesses 136 and 138, respectively. Ball J will therefore roll from the aperture 24 into the recess 136 and then down the lower surface thereof to the left, in the direction of arrow M, behind the first plate 12. In a similar manner, ball K will roll from the aperture 26 into the recess 138 and then roll to the left in the direction of arrow N. The ball L in aperture 38 is, however, in registration with the corresponding row H recess 124 and will roll thereinto, and be retained therein as the front plate 12 is moved farther upwardly.

Such further upward movement of the front plate 12 brings the row D first aperture 64 into communication with the 1 recess 124 containing the ball L and also with the recess 136 containing the ball J, the balls L and J then rolling downwardly out of their respective recesses and to the arcuate lower portion 86 of the aperture 64, (arrows P and Q respectively), gravity causing the two balls to assume contacting positions with the contacting surfaces centered along the vertical centerline of the 1 recess 124. In a like manner, the second aperture 66 simultaneously moves into communication with the recess 138 holding the ball K which ball then falls and rolls (arrow R) to the arcuate bottom portion 86 of the aperture 66. However, since there is just the single ball K, gravity now centers the ball in alignment with the 2 recess 126 which was initially by-passed by the ball K (as was described above).

Figure 12:
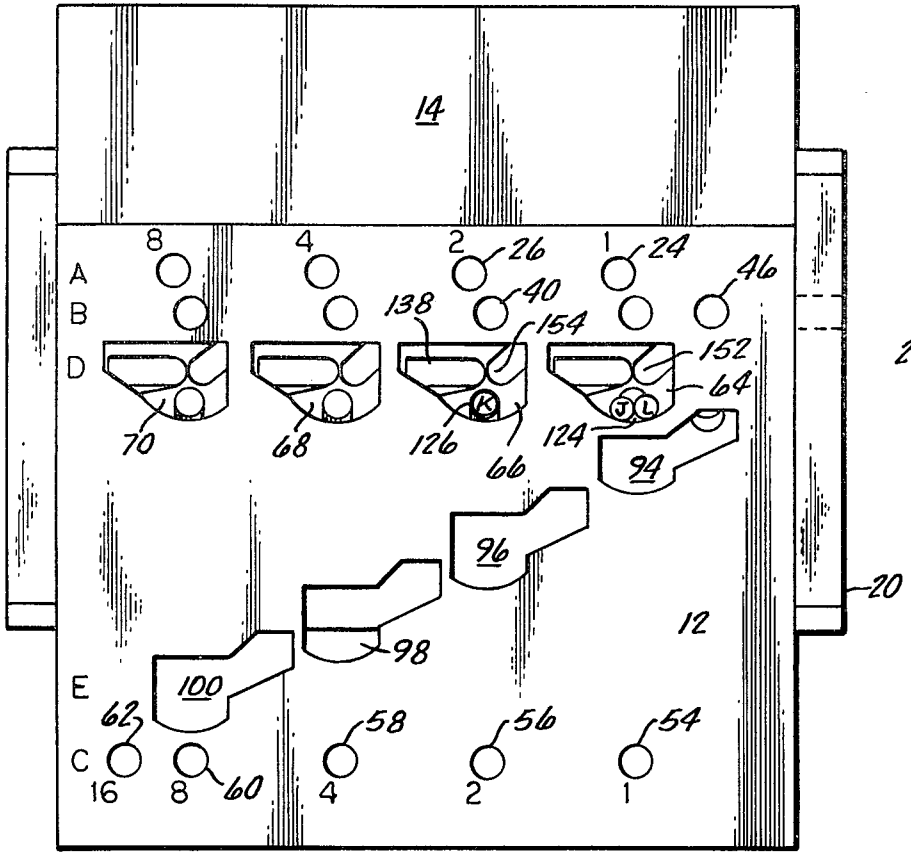

FIG. 12 shows that, as the front plate 12 is moved farther upwardly, both the balls J and L in the aperture 64 roll upwardly bypassing the recess 124 (which had initially received ball L, FIG. 10), being to sides thereof. The ball K in aperture 66 is, however, introduced into the 2 recess 126, since it cannot by-pass the recess.

Figure 13:
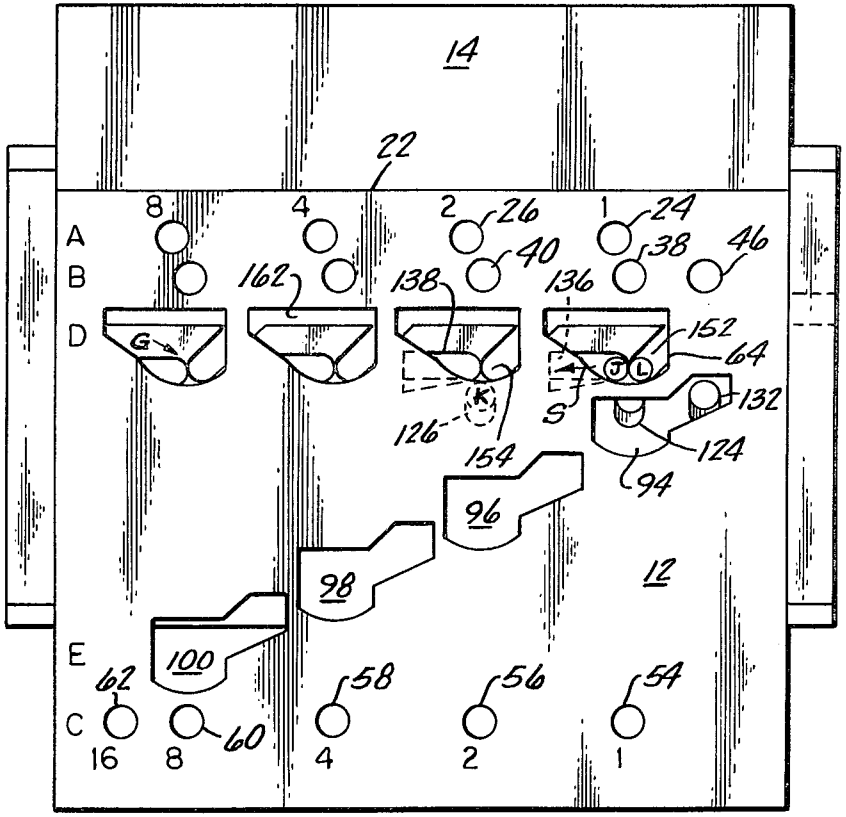

An instant later, as seen in FIG. 13, upward movement of the plate 12 introduces the balls J and L, respectively, into the row G and H recesses 136 and 152. Note that ball J has now been reintroduced into the same recess 136 in which it had been initially introduced from the aperture 24 (FIG. 10) and the ball again rolls leftwardly in the recess, in the directions of arrow S. The ball K, just previously introduced into the recess 126 is retained therein by the first plate 12.

Figure 14:
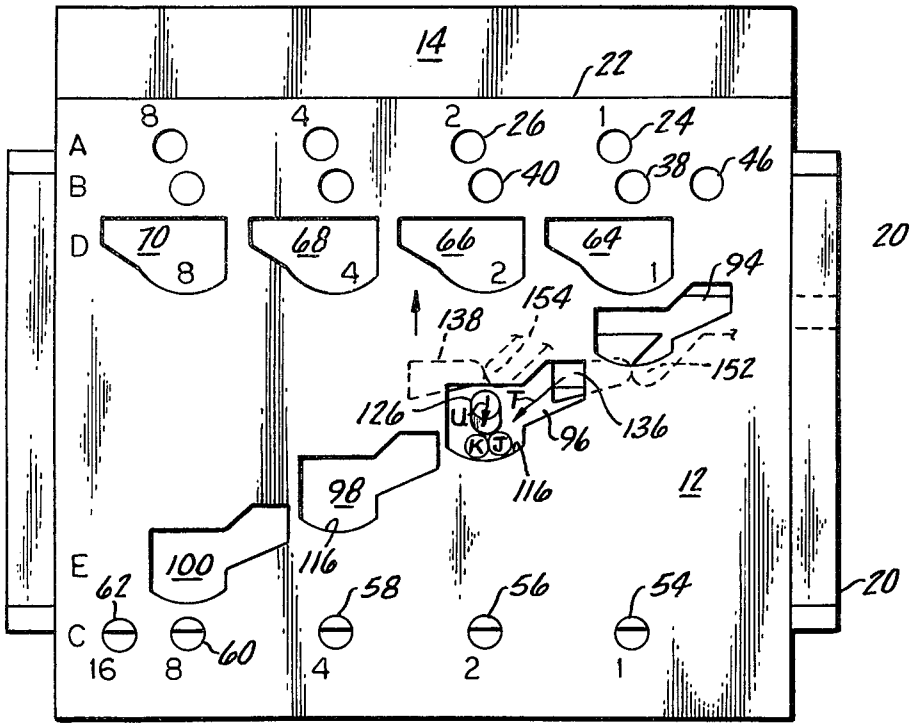
Figure 1B:
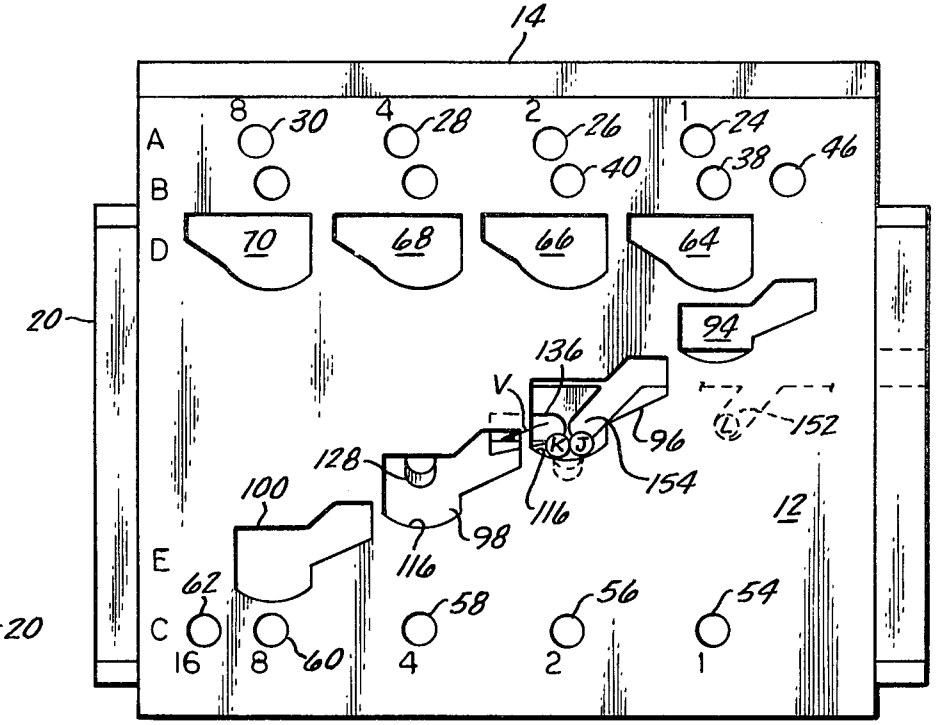
Figure 1A:
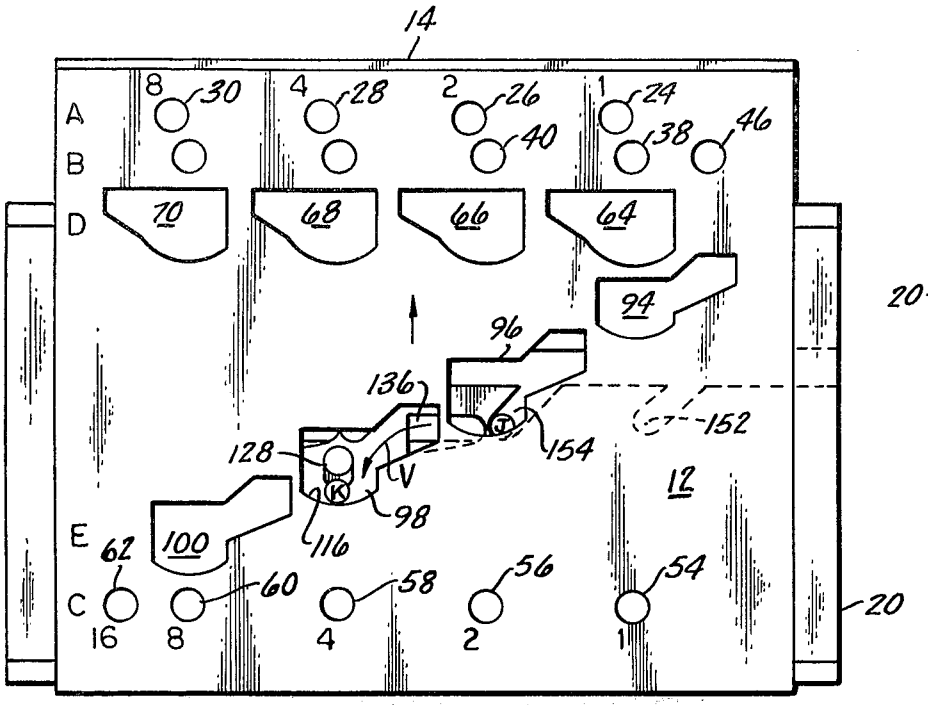
Figure 10:
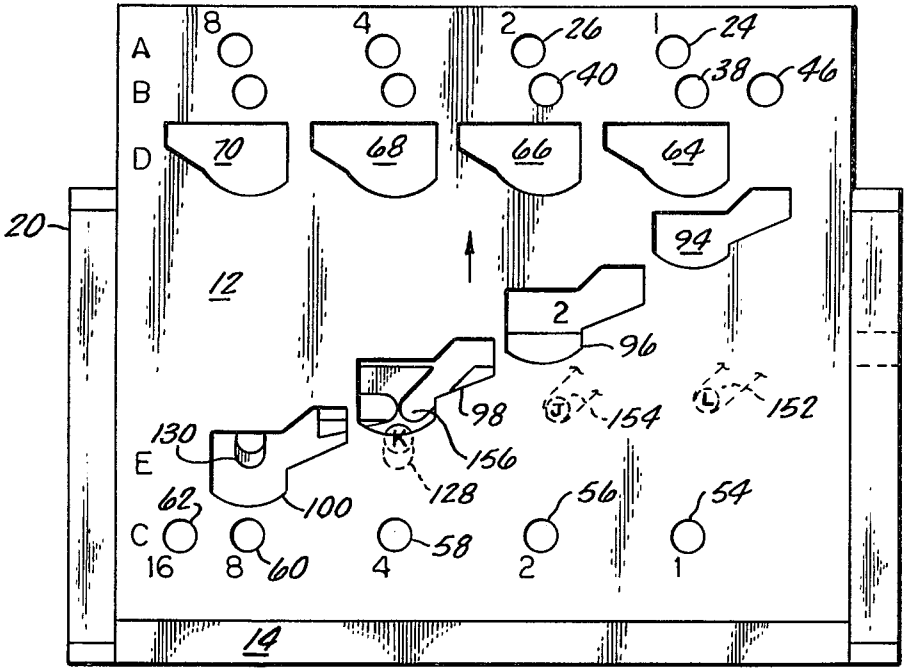
Figure 11:
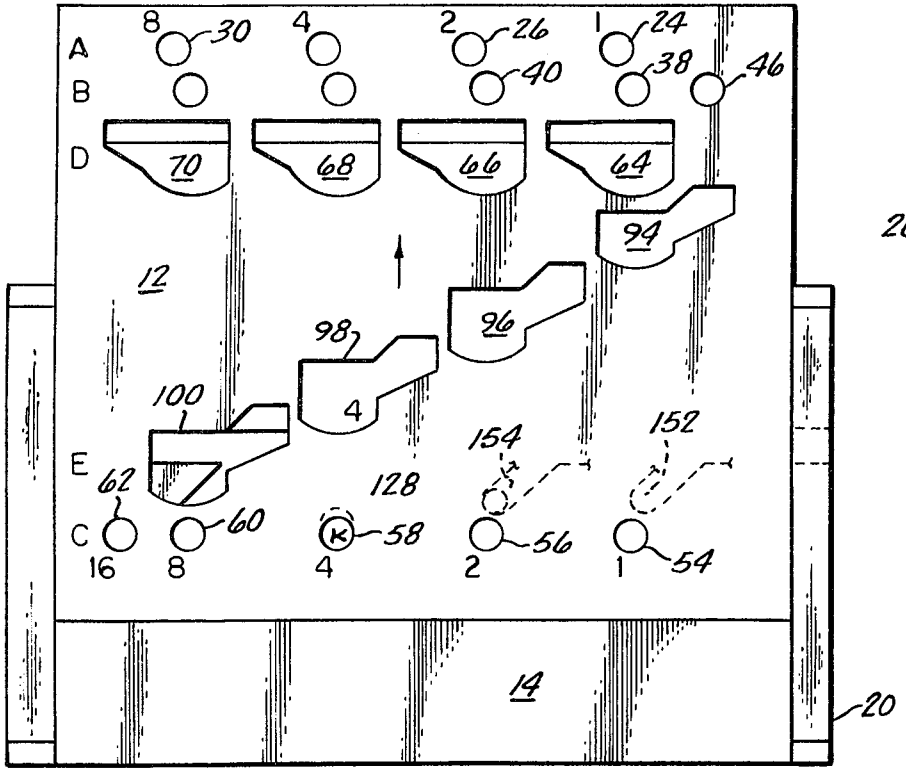

The binary addition principle of "1 plus 1 equals zero, carry 1" is illustrated in FIG. 14, in which the front plate 12 is shown moved further upwardly so that the row E second aperture 96 is now in communication with the row G first recess 136 containing the ball J and also with the row F recess 126 holding the ball K. Both balls J and K fall and roll downwardly from their respective recesses 136 and 126 to the arcuate bottom portion 116 of the aperture 96 (arrows T and U respectively) and roll into mutual contact under gravity. It is observed that ball L remains trapped in the recess 152 and will continue to remain so trapped. There are no longer either of the two balls J and L, (which were initially "entered" in the 1 positions of rows A and B as the right hand digit of the binary numbers 0011 and 0001) available for being introduced into the row C 1 aperture 54 and one of the balls — ball J — has been "carried" over to the next, 2 column of apertures and recesses.

Now, as upward movement of the first plate 12 continues, and as seen in FIG. 15, both the balls, J and K in the aperture 96 bypass the recess 126 from which the ball K had fallen into the recess, the balls being to the side of the recess. The ball J is then introduced into the row H second recess 154 and remains trapped therein because of the recess shape. The ball K, introduced into the row G second recess, rolls leftwardly and then downwardly (direction of arrow V, FIGS. 15 and 16) into the bottom portion 116 of the row E third aperture 98, above the row C 4 aperture 58, again showing that "one plus one equals 0, carry one", in the manner above described, there no longer being any ball available in the 2 column and one ball — ball K — being "carried" over to the next, 4, column.

As the front plate 12 upward movement is continued, the ball K is introduced from the aperture 98 into the row F 4 recess 128 (FIG. 17) and held therein by the front plate until the row C 4 aperture 58 becomes registered with such recess, at which position the ball K falls into that aperture (FIG. 18).

This completes the addition operation, the sum of the binary numbers 0011 and 0001, 0100 (corresponding to the number 4), being "read" from the row C apertures with the only ball in the apertures 54–62 being the ball K in the 4 aperture 58.

After the operation is completed, balls may be removed from the row C holes (assuming the holes are covered by the transparent cover 18) by holding the plates vertically and moving the front plate 12 upwardly until the row C holes are aligned with the back plate slot 162. The balls in row C can then be dropped into the slot 162 and extracted through the aperture 164.

It can thus be visually demonstrated to an operator that the addition of the two binary numbers 0011 (3) and 0001 (1) equals 0100 (4). Other binary numbers "entered", by means of the balls 16, into rows A and B apertures can be added in a similar manner, the result being read from the row C apertures by examining the position of balls introduced thereinto from rows A and B in the manner described. At the completion of the operation, any balls 16 trapped in the row H recesses may be recovered by tilting the apparatus 10 so that the balls enter the recess 162 and roll out of the aperture 164.

In a similar manner one selected binary number can also be substracted from another by introducing the first number into the row A apertures and then by: (a) introducing the complement of the second number into the row B apertures and (b) introducing an additional ball 16 into the row B — aperture 46. For example, if the binary number 0011 is to be substracted from another binary number, the number 1100 is "entered" into row B, (that is, balls 16 are inserted in the apertures 42 and 44 only) and a third ball is inserted into — aperture 46. The answer is obtained in row C in the manner above described for addition, with the exception that a ball in row C aperture 62 is ignored in reading the answer.

Although provision for only four binary digits in rows A and B has been illustrated and described, it is obvious that by continuing the row A–H apertures and recesses to the left in larger plates 12 and 14, any desired number of binary digits may be easily and economically provided.

It is emphasized that no moving parts are employed except the two plates 12 and 14, and that the operation of moving the front plate 12 relative to the rear plate 14 may be performed as slowly as desired in order to enable an operator to study movement of the balls 16 and analyze the effect of such movements. If desired, the front plate 12 may be constructed of transparent material so that movement of the ball 16 can be more fully observed.

In the manner shown and described, an easily operated, simple and inexpensive mechanical apparatus for adding and substracting binary numbers and teaching such addition and substraction can readily be constructed.

Although there has been described above a specific arrangement of a mechanical binary number adding and substracting apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A mechanical binary apparatus for operating on binary numbers, which comprises:

a. a number of similarly sized balls for representing binary "ones", b. a first plate, said first plate including means for defining a first row of apertures through the first plate and enabling entry of a selected first binary number by inserting ones of said balls only in those first row apertures which are to correspond to binary "ones" of said first selected number and for defining a second row of apertures through the first plate, spaced from the first row of apertures, and enabling entry of a selected second binary number by inserting ones of said balls only in those second row apertures which are to correspond to binary "ones" of said second selected number and also for defining a third row of apertures through the first plate and spaced from the first and second rows of apertures for receiving balls from said first and second rows of apertures to indicate the binary sum of the two selected numbers, c. a second plate cooperating with the first plate, and d. means associated with the first and second plate for conducting at least some of the balls inserted into the first and second rows of apertures from said first and second rows to the third row of apertures in a manner causing the arrangement of conducted balls received by said third row to indicate those binary "ones" which represent the "ones" portion of the binary sum of said first and second selected binary numbers, said binary sum being thereby indicated by said third row, said conducting means being responsive only to generally vertical movement of the first plate relative to the second plate after said plates are brought into sliding engagement in a predetermined manner.

2. The apparatus according to claim 1, wherein said conducting means includes means for defining fourth and fifth spaced rows of ball receiving apertures through the first plate and also means for defining first, second and third rows of ball receiving recesses in first plate contacting side of the second plate.

3. The apparatus according to claim 2, wherein each of said fifth rows of first plate apertures are arranged in a stair-step manner, each aperture being, when the first plate is vertical, higher than an aperture in that row to a common side, and wherein said fourth and fifth rows of apertures are formed between said second and third rows of apertures.

4. The apparatus according to claim 2, wherein apertures in said first, second and third rows of first plate apertures are generally circular in cross-section and are of a diameter slightly larger than the diameter of said balls to permit free passage of the balls therethrough.

5. The apparatus according to claim 2, wherein each of the apertures in the fourth and fifth rows of first plate apertures is formed having a two dimensionally concave lower ball receiving surface, the curvature of said surfaces being in the plane of the first plate and being several times the radius of the balls.

6. The apparatus according to claim 5, wherein the centers of corresponding ones of its apertures in said second and third rows of apertures and the center of curvature of the concave lower surfaces of corresponding apertures of the fourth and fifth rows of apertures are in substantial vertical alignment, the centers of corresponding apertures of the first row of apertures being offset to one side of said vertical alignment by approximately the radius of the balls.

7. The apparatus according to claim 6, wherein apertures of said fourth and fifth rows of apertures are configured so that portions of each aperture in the fifth row of apertures are below both a corresponding aperture and a next adjacent aperture in the fourth row of apertures.

8. The apparatus according to claim 6, wherein ball entrance portions of the second and third rows of second plate recesses are at the same elevation when the second plate is held in a generally vertical, use position, said entrance portions of adjacent second and third row recesses having a common side edge contact point which, when said first and second plates are brought into mutual contact in said predetermined manner, is in vertical alignment with corresponding apertures of the second and third first plate rows of apertures and the center of radius of corresponding lower concave portions of the apertures in the fourth and fifth rows of first plate apertures.

9. The apparatus according to claim 8, wherein the first row of second plate recesses is positioned closely below the second and third rows of recesses, each of the first row recesses being generally circular in cross-section and having a diameter slightly greater than the diameter of the balls, each of the first row recesses being vertically centered below the common edge contact point of corresponding recesses of the first and second rows of recesses, and therefore also in vertical alignment with corresponding apertures of the second and third rows of first plate apertures and centers of radius of corresponding lower concave portions of the apertures of the fourth and fifth rows of first plate apertures when the first and second plates are brought into mutual contact in said predetermined manner.

10. The apparatus according to claim 9, wherein lower surfaces of each of the recesses in said first row of second plate recesses are slanted downwardly and forwardly so that when the two plates are brought into sliding engagement in said predetermined manner and the first plate is moved upwardly relative to the second plate, balls introduced into recesses of said first row of recesses from a corresponding aperture in any of the second, fourth and fifth rows of first plate apertures will be returned to the corresponding next vertical aperture in the fourth, fifth and third row of first plate apertures.

11. The apparatus according to claim 6, wherein side portions of each recess of the second row of second plate recesses are extended towards a common side to the extent that recess end portions thereof, when the two plates are brought into sliding engagement in said predetermined manner, are in vertical alignment with portions of a corresponding aperture in the fourth row of first plate apertures and with both a corresponding one and an adjacent one of the apertures in the fifth row of first plate apertures.

12. The apparatus according to claim 11, wherein lower surfaces of said extended side portions of recesses in the second row of recesses are beveled in a manner causing balls introduced into the entrance portions thereof from any of the first plate apertures are caused to roll sideways to said end portions thereof and are also caused to be discharged into the next first plate aperture communicating therewith when the first plate is moved upwardly relative to the second plate.

13. The apparatus according to claim 8, wherein lower surfaces of the entrance portions of recesses in said third row of second plate recesses are beveled downwardly and rearwardly so that balls introduced thereinto from any of the first plate apertures will be retained therein and not be discharged into any other first plate apertures subsequently brought into communication therewith.

14. The apparatus according to claim 13, wherein portions of each of the third row recesses are joined to a common recess, said common recess communicating to the exterior of the apparatus to enable any trapped balls to be removed from the apparatus.

15. The apparatus according to claim 8, wherein apertures in said fourth and fifth rows of first plate apertures and recesses of said first, second and third rows of second plate recesses are configured so that when said two plates are brought into sliding engagement in said predetermined manner and the first plate is slid upwardly relative to the second plate and when there is only one ball in any odf the apertures of the fourth and fifth rows of first plate apertures said ball will be caused to be introduced into a corresponding one of the recesses of the first row of second plate recesses, and when there are two balls in any of the apertures in said fourth and fifth rows of apertures, both balls will be caused to bypass said corresponding first row recess, one of said two balls being then caused to be introduced into a corresponding one of the recesses of the second row of second plate recesses and the other of said two balls being caused to be introduced into a corresponding one of the recesses of the third row of recesses and be retained therein during subsequent relative movement between the two plates.

16. The apparatus according to claim 2, including means enabling substraction of a second, smaller selected binary number, the complement of which is entered by the balls into said second row of apertures, from a first larger binary number entered by the balls in said first row of apertures, the difference of said two numbers being caused, by the conducting means, to be indicated by balls received in the third row of apertures from the first and second rows when the two plates are brought into sliding engagement and the first plate is moved relative to the second in a generally vertical manner.

17. The apparatus according to claim 16, wherein said means enabling subtraction includes means defining a "minus" ball receiving aperture at an end of said second row of first plate apertures, one of said balls being introduced into said "minus" aperture when a subtraction operation is to be performed, and further means defining a corresponding recess at an end of said first row of second plate recesses.

18. The apparatus according to claim 17, wherein said "minus" aperture is in vertical alignment with a first one of said fourth row apertures.

19. The apparatus according to claim 2, wherein each of the rows of first plate apertures has defined therein the same number of apertures, except for the third row which has defined therein an additional aperture so that a binary number having one digit larger than either of the first and second binary numbers entered into the first and rows row of apertures can be indicated, and wherein each of the rows of second plate recesses has defined therein the same number of recesses as the number of apertures defined in any but the third row of apertures.

20. The apparatus according to claim 2, including a transparent cover sheet covering a front surface of the first plate in the region of the fourth and fifth rows of apertures to prevent any of said balls introduced into apertures of said fourth and fifth rows from unintentional removal therefrom.

21. The apparatus according to claim 1, including guide means for enabling said first and second plates to be slidingly engaged in said predetermined manner.

* * * * *